United States Patent [19]

Barry

[11] Patent Number: 4,955,168

[45] Date of Patent: Sep. 11, 1990

[54] MOUNTING STRUCTURE FOR ARCUATE WINDOW FRAMES

[75] Inventor: Michael Barry, Santa Ana, Calif.

[73] Assignee: Daniel A. Neihold, Orange, Calif.

[21] Appl. No.: 418,986

[22] Filed: Oct. 6, 1989

Related U.S. Application Data

[63] Continuation of Ser. No. 365,957, Jun. 14, 1989, abandoned, which is a continuation of Ser. No. 320,756, Mar. 8, 1989, abandoned, which is a continuation of Ser. No. 183,762, Apr. 20, 1988, abandoned.

[51] Int. Cl.[5] ..... E06B 1/04

[52] U.S. Cl. ..... 52/210; 52/211; 52/213; 52/86

[58] Field of Search ..... 52/86, 204, 211, 210, 52/213; 49/504

[56] References Cited

U.S. PATENT DOCUMENTS

| | | | |
|---|---|---|---|
| 1,762,363 | 6/1930 | Sergent | 52/86 |
| 2,011,796 | 8/1935 | Christensen | 52/204 |
| 4,301,632 | 11/1981 | Wagner | 52/211 |
| 4,601,138 | 7/1986 | Hampton | 52/86 |
| 4,642,955 | 2/1987 | Webb | 49/504 |
| 4,665,666 | 5/1987 | Hampton | 52/86 |
| 4,780,998 | 11/1988 | Knapp | 52/211 |

FOREIGN PATENT DOCUMENTS

| | | | |
|---|---|---|---|
| 94811 | 10/1969 | France | 52/2 |

*Primary Examiner*—James L. Ridgill, Jr.
*Attorney, Agent, or Firm*—Stetina and Brunda

[57] ABSTRACT

An arcuate window frame mounting structure is disclosed comprising an arcuate member sized and configured to be inserted within an existing wall structure, such that the outer edge of the member will interface with the back side of an exteriorally mounted arcuate window frame while the inner edge of the member will be flush with the inner edges or surfaces of the adjacent wall studs. In addition, methods of forming the arcuate window frame mounting structure are disclosed.

6 Claims, 2 Drawing Sheets

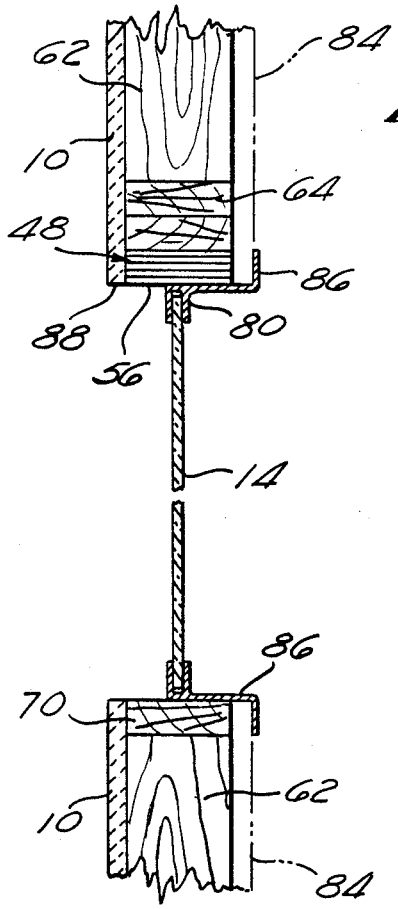
Fig. 6
Fig. 7a
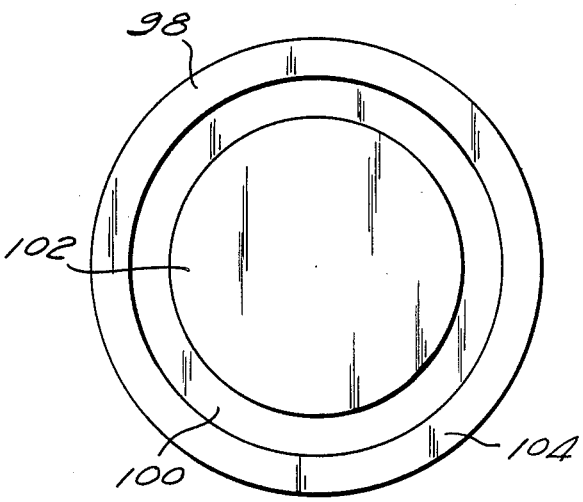
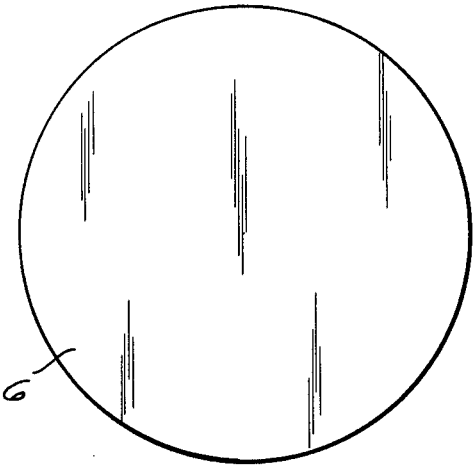
Fig. 7b
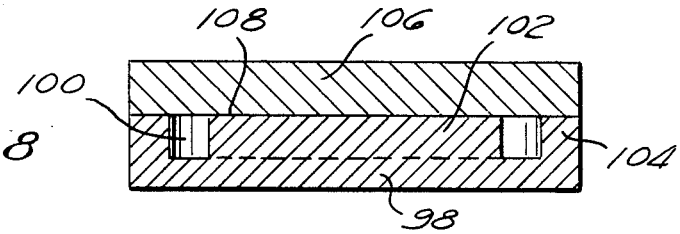
Fig. 8

MOUNTING STRUCTURE FOR ARCUATE WINDOW FRAMES

This application is a continuation of application 07/365,957 filed June 14, 1989, now abandoned, which was a continuation of application 07/320,756 filed Mar. 8, 1989, now abandoned, which was a continuation of application 07/183,762, filed Apr. 20, 1988, now abandoned.

This application pertains generally to the art of building construction and, more particularly, to the placement and mounting of round or arch-shaped window an/or door frames.

The invention is particularly applicable to new building construction and will be described herein with particular reference thereto, although it must be appreciated that the invention has broader applications and will also find utility as a retrofit item to be used in renovating or remodeling existing structures.

BACKGROUND OF THE INVENTION

The placement, mounting and peripheral enclosure of modern, exteriorly mounted round or arch-shaped windows has heretofore required considerable skill and labor. For example, the prior art methods of installing arched windows required the cutting and nailing of short sections of two-by-four or other wooden material between adjacent wall studs and under a window "header" to roughly approximate an arcuate pattern so as to generally correspond with the arcuate shape of the exteriorly mounted window frame. The interior drywall of other wall covering material is then cut to the arcuate shape of the window and nailed over the top of the roughly arranged two-by-four support sections.

Provided that the drywall has been correctly cut and properly placed against the underlying two-by-four support, the builder must then "fill in" the area between the arched edge of the drywall and the outer window frame to create a smoothly arched window jamb such that the jamb will be perpendicular at any given point to the interior wall surface. The creation of such window jamb often requires the insertion of plywood or other filler materials in an effort to occupy any void existing between the interior drywall and the exterior window frame. After such void has been filled, plaster or other appropriate filler materials must then be applied to form the desired arched window jamb surface.

The above described prior art methods of mounting and finishing arched windows are known to be time consuming and to result in non-uniform and oftentimes uneven interior wall and window jamb surfaces. Because such defects are usually readily visible from within the room, the builder is often called upon to undertake remedial work after the interior walls have been finished and painted. Thus, there exists a need in the art for a simple, inexpensive and uniformly shaped arcuate mounting structure which may be inserted behind the exteriorly mounted arcuate window frame so as to uniformly fill the area between the window frame and the interior drywall, thereby creating a smoothly arched and uniform window jamb surface.

In view of the aforestated problems of the prior art, the present invention is intended to provide the desired light-weight, inexpensive and simple arcuate window frame mounting structure whih may be reproducibly manufactured in a range of sizes and thicknesses to accommodate various sizes of window frames and various construction methodology.

BRIEF SUMMARY OF THE INVENTION

In accordance with the invention there is provided an arcuate window frame mounting structure comprising an arcuate member sized and configured to be inserted within an existing wall structure such that the outer edges of the member will interface with the back side of an exteriorly mounted arcuate window frame, while the inner edge of the member will be flush with the inner edges or surfaces of the adjacent wall studs. By such arrangement, the interior drywall or other wall covering material may be directly attached to the inner surface of the arcuate member and subsequently cut in conformity with the uniform edge contour of the arcuate member. When in place, the underside or lower surface of the arcuate member will form a smoothly arched and uniform window jamb surface.

In accordance with another aspect of the invention, the arcuate member may comprise a laminated structure consisting of individual thin wooden members formed around an arcuate jig and bonded in juxtaposition to one another so as to provide a unitary laminated structure of predetermined size and thickness. Similarly, thin strips of wooden, paper, textile or other materials may be laid upon a rotating circular mandrel with appropriate bonding agents being applied to provide a generally rigid, circular lamenated member. Such circular embodiment may be used as a single piece for the mounting of circular window frames or may be cut into two separate arcuate (semicircular) sections for use with correspondingly shaped arcuate (semicircular) window frames.

In accordance with still another aspect of the invention, the arcuate member may be formed of bonded particles or fibrous material such as wood or paper. In such embodiment, the particulate or fibrous material, along with any binding agents or other ingredients may be poured or injected into an arcuate or circular mold. Under sufficient temperature, pressure and other conditions, the desired arcuate or circular structure will thus be formed within the mold. If a full circular mold is used, the circular member so formed will be subsequently cut in half so as to form two separate arcuate (semi-circular) members of the foregoing character.

In accordance with yet another aspect of the invention, each arcuate window frame mounting structure may be specifically sized to fit a particular type of window and/or to accommodate a specific type of wall construction. Thus, the height and width of the arcuate member will be generally the same as the height and width of the particular arch-type window frame being mounted. Additionally, the outer edge to inner edge dimension of the arcuate member will be specifically prescribed so that the outer surface of the arcuate member will interface with the back side of the window frame while the inner surface remains flush with the inner edges of the adjacent wall studs and other wall structures. By providing an arcuate member having such specific outer to inner dimension, the invention will serve to fully fill the existing space between the window frame and the interior wall covering and will create a smoothly countoured, arched window jamb extending outwardly from the innter drywall surface to the inside edge of the window frame.

One object of the invention is to provide a simple and cost effective unitary structure for supporting arcuate window frames and for providing a uniformly arched inner edge against which the drywall may be uniformly form-cut and finished.

Another object of the invention is to provide an arcuate window frame mounting structure which will form a smoothly countoured and reproducible window jamb conforming to the arched shape of the window frame and running perpendicular to the inner wall surface.

Still another object of the invention is to provide convenient, inexpensive and reproducible methods of manufacturing the arcuate window frame mounting structures of the foregoing character.

Additional objects and advantages of the invention will become apparent to those skilled in the art upon reading and understanding of the following detailed description and the accompanying drawings.

BRIEF DESCRIPTION OF THE DRAWINGS

FIG. 6 is a cross-sectional view of a wall having an arcuate window frame mounted therein, including the window frame mounting structure of the present invention;

FIG. *7a* is a plan view of the core portion of a circular mold by which a preferred molded embodiment of the present invention may be prepared;

FIG. *7b* is a plan view of the cover plate portion of a circular mold by which a preferred molded embodiment of the present invention may be prepared; and FIG. 8 is a cross-sectional view through the midline of a circular mold by which a preferred molded embodiment of the present invention may be prepared.

DETAILED DESCRIPTION OF THE PREFERRED EMBODIMENTS

Figure 1:
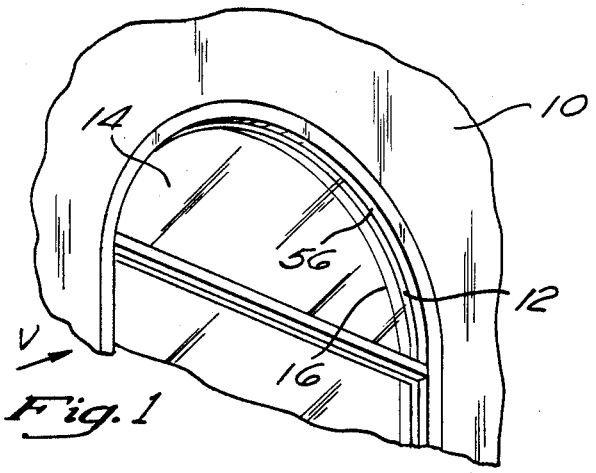
FIG. 1 is a perspective view of the arcuate window frame mounting structure of the present invention.

Referring now to the drawings wherein the showings are for purposes of illustrating preferred embodiments of the present invention, and not for purposes of limiting the same, FIG. 1 provides a perspective view of an arcuate window mounted within a building wall. The showing of FIG. 1 indicates the interrelationship of the arcuate member of the present invention with the surrounding wall and window structures as if the window were viewed from inside the building at a vantage point off to the left of the window shown in FIG. 1, as indicated by arrow V. Accordingly, FIG. 1 shows an interior wall surface 10 having an arched window mounted therein. As shown along the right side of FIG. 1, the lower surface of the invention device 56 is visible from inside the room and forms a smooth window jamb extending around the general arcuate shape of the window. The window frame 12 has an arcuate pane of glass 14 positioned therein. The outer wall surface 16 is also visible as an edge along the underside of the building as seen through window pane 14.

Figure 2:
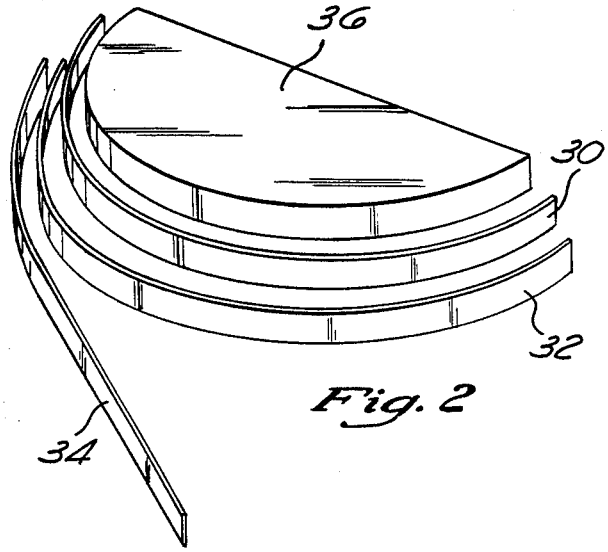
FIG. 2 shows a preferred lamination method of constructing the arcuate window frame moutning structure of the present invention.

Referring to FIG. 2, the arcuate window frame mounting structure of the present invention may be formed by the laminar disposition of multiple wood laminates 30, 32 and 34. The individual laminates 32, 33, 34 are formed around an arcuate jig structure 36 with a glue or other binding agent being interfacially deposited between the individual laminates 30, 32 and 34 so as to result in a rigid laminated structure having the desired arcuate shape.

Figure 3:
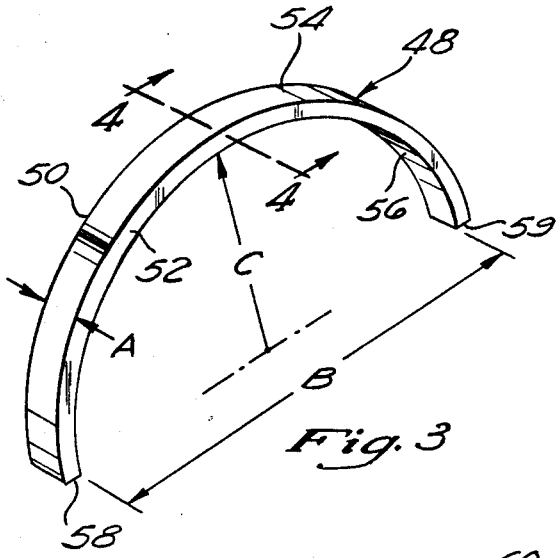
FIG. 3 is a perspective view of an arcuate window frame mounting structure of the present invention.

FIG. 3 shows a perspective view of the arcuate window frame mounting structure 48 of the present invention. The structure is generally characterized by an outer edge 50, an inner edge 52, an arcuate upper surface 54 and an arcuate lower surface or underside 56.

The critical dimensions of the device shown in FIG. 3 include the inner edge to outer edge width A. The overall arch width B is generally the distance between opposite ends 58 and 59 of the arched member while the height of the member is the distance C between the base and the highest point of the arch.

The arcuate support structure of the invention will be manufactured such that each of the above-defined critical dimensions are specifically sized to fit within a particular type of wall construction and/or to accomodate particular window frame sizes and shapes.

Figure 4:
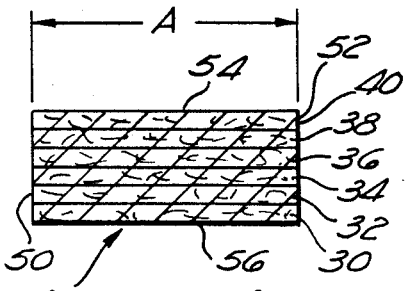
FIG. 4 is a cross-sectional view taken through line 4—4 of FIG. 3.

FIG. 4 shows a cross-section of the arcuate window frame mounting structure 48 taken through line 4—4 of FIG. 3. Such cross-sectional view shows numerous individual laminates 30–40 fused together to form a unitary, laminated structure. The outer edge 50 and inner edge 52 of the structure are smooth surfaces generally perpendicular to the structure's upper surface 54 and bottom surface 56.

Figure 5:
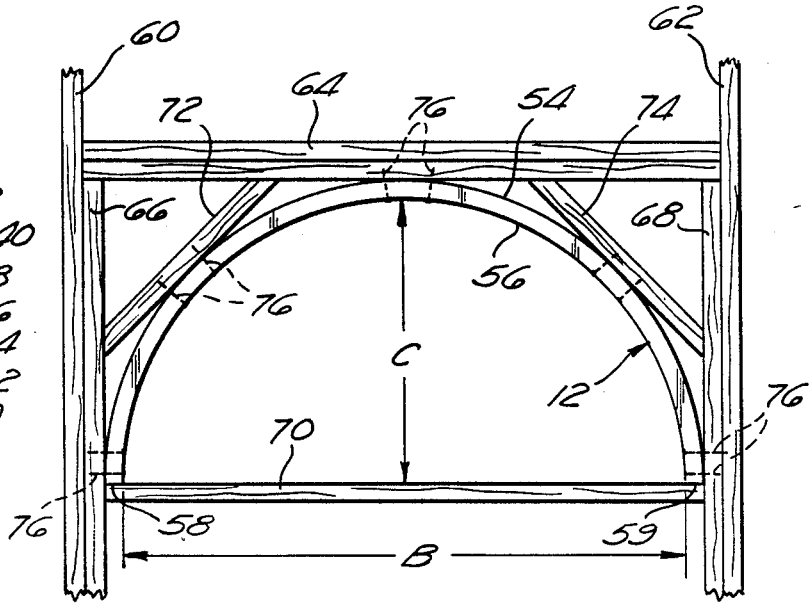
FIG. 5 is an elevational view of an arcuate window frame mounting structure of the present invention operatively positioned within a wall.

In the showing of FIG. 5, the arcuate structure 12 of the present invention of height C and width B is positioned within an existing wall structure. Specifically, adjacent wall studs 60 and 62 are located on either side of the arcuate structure 12. Studs 60 and 62 are generally constructed of two-by-fours or similar lumber. A header structure 64 is formed of horizontally juxtapositioned two-by-fours and extends over the top of the arcuate structure 12 and between wall joists 60 and 62. Trimmer boards 66 and 68 comprise two-by-fours attached to the inner surfaces of wall studs 60 and 62. A sub-sill 70 extends horizontally at the base of the arcuate structure 12 and is joined perpendicularly at either end to trimmer boards 66 and 68. As shown, the arcuate structure of width B fits snuggly between trimmer boards 66 and 68 with the opposite ends 58 and 59 of the structure generally abutting and connected to the trimmer boards 66 and 68. Also, the arch height C is specifically prescribed so that the upper surface 54 of the arch will come in contact with diagonal members 72 and 74. Also, the height point on the upper surface of the arch will meet with and be attached to a point on the horizontal header 64. Thus, the arcuate structure 12 is firmly connected to each of the adjacent structures by multiple connecting means 76. Such connecting means 76 may consist of nails, brads, corrogated connectors or any other apparatus capable of joining wooden members.

As shown in FG. 5, the arcuate window frame mounting structure 12 of the present invention is specifically sized to fit within an existing wall opening and to be simply and firmly joinable to the surrounding wall structures so as to provide a uniformly arched "filler member" directly behind the exterior window frame and extending inwardly. Thus, the structure 12 provides a uniformly arched inner surface against which the drywall may be neatly edged. The underside 56 of the arcuate structure 12 forms an even and consistent window jamb which may be painted, wallpapered, or otherwise finished to match the inner wall surface.

The manner in which the exterior window frame and the interior wall board interact with the present invention is shown in FIG. 6 which shows a cross-sectional representation of a building wall having an arcuate window mounted thereon, utilizing the arcuate window frame mounting device of the present invention. The cross-sectional view of FIG. 6 is taken downwardly through the approximate highest point of the arcuate window. The arcuate window frame 80 holds an arcuate window pane 14. The window pane 14 is firmly held within the frame 80.

One or more nails are passed upwardly through the top of frame 80 into the arcuate support member 48 of the present invention. Similarly, at its bottom, the window frame 80 is nailed horizontally into the adjacent sub-sill 70. An outer wall covering material 84, such as lath, stucco or other exterior wall construction material is applied to the outside of the building wall such that the outer wall covering material 84 will directly abut the raised outer lip 86 of the window frame 80.

The interior wall surface 10 may consist of drywall or any other interior wall covering material. The interior wall surface 10 is cut flush with the underside 56 of the arcuate member 48 so as to provide a smooth and uniform arcuate edge 88. The underside 56 of the device, being flush with the drywall edge 88 and extending outwardly to the window frame 80, forms a smoothly arched window jamb which is easily visible from inside the room. Thus, when viewed from the inside, the surrounding drywall or other wall covering 10 will terminate in a clean cut arcuate edge 88 analogous with the shape of the window with a uniform window jamb surface 56 extending outwardly therefrom. Such smooth and uniform pattern was heretofore not reproduceably attainable by the various methods of the prior art because no clean uniform arcuate surface was present to serve as a filler structure between the back side of the window frame 80 and the interior drywall 10.

An alternative means of manufacturing the arcuate window frame mounting structure of the present invention is shown in FIGS. *7a–b* and 8. FIG. *7a* shows a plan view of the core portion 98 of a circular mold. The mold is provided with a generally circular cavity 100 wherein any suitable material may be molded. Such molded circular structure may subsequently be cut in half to form two separate arcuate window frame support structures of the present invention. The circular mold cavity 100 is defined by a circular central core region 102 and a peripheral shell 104.

A top plate 106 is shown in FIG. *7b*. Such top plate 106 is clamped directly on top of the core portion of the mold shown in FIG. *7a*. Thus, a sandwich-like mold enclosure is formed as shown cross-sectionally in FIG. 8.

With reference to FIG. 8, the mold comprises a top plate 106 and a core portion 98. The core portion 98 is provided with a circular central core region 102 and a peripheral shell 104 defining the mold cavity 100. The central core region 102 and peripheral shell meet directly with the top plate 106 at parting line 108. Thus, compression of the mold halves will result in the material within the circular cavity being compressively held therewithin. The mold may further be provided with any requisite temperature control or part-releasing features in accordance with standard mold making techniques. By such arrangement, the mold shown in FIG. 8 may be used to form an arcuate support structure of the present invention from a quantity of wooden or paper particles (e.g., cellulose fiber, shredded paper, sawdust, wood, and possible combinations thereof) along with various binding agents or other chemicals capable of resulting in a composite structure of sufficient integrity to serve the desired functions of the present invention as described above.

In addition to forming the inventive structure through the use of chemically bound particles and other composite materials, a mold similar to that shown in FIGS. 7 and 8 may be used to form the inventive structure out of various materials. Indeed, a wide range of available materials will permit the invention to be made to any required degree of structural integrity, weight, strength, density or other properties required by the particular final application.

Also, strips of various wooden, paper, textile or other materials may be applied along with appropriate bonding agents, to a rotating circular mandrel to form a laminated circular member embodying the present invention. As with the circular molded embodiment described above, such circular laminated member may be utilized in a single piece for the mounting of circular window frames, or the circular member may be cut in half in order to form two separate arcuate (semicircular) members for use in mounting arcuate (semicircular) window frames.

It is to be understood that the invention has been described and illustrated herein with respect to a presently preferred embodiment only, and that various modifications and additions may be made to such embodiment without departing from the spirit and scope of the present invention. For example, the present invention may be structured to accomodate various non-rectangular windows in addition to the arch-type windows disclosed herein. Such other configurations may include various irregularly polygonal shapes, as well as irregular arch shapes wherein the uniform cutting and edging of drywall would be a problem absent the use of a device such as that described herein. Also, the materials of which the inventive structure is formed may include any materials capable of performing the functions of the inventive structure and is certainly not limited to the laminated or molded embodiments described herein.

What is claimed is:

1. A device positionable of a framed wall opening to form an arcuate window jamb between a window frame mounted about the exterior of said framed wall opening and a wall board mounted about the interior of said framed wall opening, said device comprising:

an arcuate member having first and second longitudinal ends, an arcuate upper surface, an arcuate undersurface, an outer edge, and an inner edge; and the width between the outer edge and the inner edge of the member being such that, when said member is positioned within said framed wall opening, the outer edge of the member will abut the arcuate window frame, the inner edge of the member will abut the wall board, and the arcuate undersurface of the member will form an arcuate jamb surface extending between said window frame and said wall board.

2. The device of claim 1 wherein said arcuate member is formed of a plurality of laminated wooden members.

3. The device of claim 1 wherein said arcuate member is formed of bonded particulate matter selected from the group consisting of:

cellulose fiber;
shredded paper;
wooden particles;
sawdust; and
possible combinations thereof.

4. The device of claim 1 wherein said arcuate member is formed of a plastic material.

5. A method for installing an exteriorly mounted arcuate window frame within a framed wall opening comprising first and second adjacent vertical wall studs, a horizontal header extending between said first and second vertical wall studs at a first location, and a horizontal sub-sill extending between said first and second vertical wall studs at a second location below said first location, said method comprising the steps of:

(a) providing an arcuate member having longitudinal dimension approximately equal to the distance between said first and second adjacent vertical wall studs and a height approximately equal to the distance between said sub-sill and said header such that said arcuate member is slidably positionable between said first and second vertical wall studs, above said sub-sill and below said header;

(b) affixing said arcuate member to each of said vertical wall studs; and (c) mounting said exteriorly mounted window frame in abutting relationship with said arcuate member such that the undersurface of said arcuate member forms a generally smooth window jamb surface extending inboard from said exteriorly mounted window frame.

6. The method of claim 5 wherein said frame wall opening is further characterized by the provision of first and second trimmer boards attached to said first and second vertical wall studs, respectively, such that said first and second trimmer boards are positioned in direct opposition to one another and wherein:

step (a) comprises providing an arcuate member having a longitudinal dimension approximately equal to the distance between said first and second trimmer boards and a height approximately equal to the distance between said sub-sill and said header such that said arcuate member is slidably positionable between said first and second trimmer boards, above said sub-sill and below said header; and wherein step (b) comprises affixing said arcuate member to each of said trimmer boards.

* * * * *